US007114477B2

(12) United States Patent
Shin

(10) Patent No.: US 7,114,477 B2
(45) Date of Patent: Oct. 3, 2006

(54) VARIABLE INTAKE SYSTEM MONITORING APPARATUS

(75) Inventor: Chang-Hyun Shin, Gyeoggi-Do (KR)

(73) Assignee: Hyundai Motor Company, (KR)

( * ) Notice: Subject to any disclaimer, the term of this patent is extended or adjusted under 35 U.S.C. 154(b) by 0 days.

(21) Appl. No.: 11/009,827

(22) Filed: Dec. 8, 2004

(65) Prior Publication Data

US 2005/0120785 A1 Jun. 9, 2005

(30) Foreign Application Priority Data

Dec. 9, 2003 (KR) ..... 10-2003-0088990

(51) Int. Cl.
*F02M 35/10* (2006.01)

(52) U.S. Cl. ..... 123/184.47

(58) Field of Classification Search ..... 123/184.47, 123/184.55, 184.21, 336
See application file for complete search history.

(56) References Cited

U.S. PATENT DOCUMENTS 5,168,954 A * 12/1992 Nakaniwa et al. ..... 180/197
5,722,365 A * 3/1998 Sadakane et al. ..... 123/336
6,695,279 B1 * 2/2004 Takahashi et al. ..... 251/61

* cited by examiner

*Primary Examiner*—Stephen K. Cronin
*Assistant Examiner*—Hyder Ali
(74) *Attorney, Agent, or Firm*—Peter F. Corless; Edwards Angell Palmer & Dodge, LLP

(57) ABSTRACT

Variable intake systems are provided that include a variable intake valve shaft, potentiometer, pneumatic actuator, Manifold Absolute Pressure sensor, Throttle Position Sensor and controller. Preferred systems of the invention can monitor whether valves of a variable intake system are properly working, thereby stabilizing the operation of the variable intake system in a simplified manner and at low costs.

6 Claims, 3 Drawing Sheets

VARIABLE INTAKE SYSTEM MONITORING APPARATUS

CROSS-REFERENCE TO RELATED APPLICATIONS

The present application is based on, and claims priority from, Korean Application Serial Number 10-2003-0088990, filed on Dec. 9, 2003, the disclosure of which is hereby incorporated by reference herein in its entirety.

FIELD OF THE INVENTION

The present invention relates to an apparatus that monitors the operation state of a variable intake system of a vehicle.

BACKGROUND OF THE INVENTION

A variable intake system is typically configured to change the length of an intake passage extended to the combustion chamber according to the engine state. The variable intake system, therefore, lengthens the intake passage during a low speed and light load for increasing the intake inertia and intake efficiency. Conversely, during a high speed and heavy load, the variable intake system shortens the intake passage to increase the intake efficiency by decreasing the intake resistance.

Conventional variable intake systems change the passage of the intake through use of valves. However, if the valves fail to operate properly, significant amounts of toxic materials can accumulate in the engine exhaust gas and deteriorate engine performance. This in turn can require the time and expense of regular inspections of the valves.

The information disclosed in this Background of the Invention section is only for enhancement of understanding of the background of the invention and should not be taken as an acknowledgement of any form of suggestion that this information forms the prior art that is already known to a person skilled in the art.

SUMMARY OF THE INVENTION

In one aspect, the present invention provides systems to monitor whether valves of a variable intake system are properly working, thereby stabilizing the operation of the variable intake system in a simplified manner and at low costs.

More particularly, in a preferred system of the invention, a variable intake system monitoring apparatus comprises a variable intake valve shaft equipped with a plurality of flaps. A potentiometer is provided that can measure the pivot amount of the variable intake valve shaft. In operation, a pneumatic actuator pivots the variable intake valve shaft. A vacuum hose is suitably employed and connects a surge tank and pneumatic actuator to provide operational pressure of the pneumatic actuator. A Manifold Absolute Pressure (MAP) sensor is preferably positioned proximate to the surge tank connected with the vacuum hose. A Throttle Position Sensor (TPS) is further preferably provided and suitably placed at or proximate to a throttle body. A controller detects the operation state of the variable intake valve shaft suitably by receiving signals from the potentiometer, MAP sensor, and/or TPS.

The invention also includes vehicles and vehicle engine systems that comprise the described variable intake system monitoring apparatus.

It is understood that the term "vehicle" or other similar term as used herein is inclusive of motor vehicles in general such as passenger automobiles, buses, trucks, various commercial vehicles, and the like.

Other aspects of the invention are discussed below.

BRIEF DESCRIPTION OF THE DRAWINGS

For a better understanding of the nature and objects of the present invention, reference should be made to the following detailed description taken in conjunction with the accompanying drawings, in which.

DETAILED DESCRIPTION OF THE INVENTION

As discussed, the invention provides variable intake system monitoring apparatus that suitably comprise: a variable intake valve shaft comprising a plurality of flaps; a potentiometer that can measure the pivot amount of the variable intake valve shaft; a pneumatic actuator that can pivot the variable intake valve shaft; a Manifold Absolute Pressure sensor; a Throttle Position Sensor; and a controller that detects the operation state of the variable intake valve shaft input (e.g. received signals) from one or more of the potentiometer, Manifold Absolute Pressure sensor, or Throttle Position Sensor. The system may suitably further include a vacuum hose or line that may connect a surge tank and the pneumatic actuator to provide operational pressure of the pneumatic actuator.

One or more preferred embodiments of the present invention now will be described in detail with reference to the attached drawings.

Figure 1:
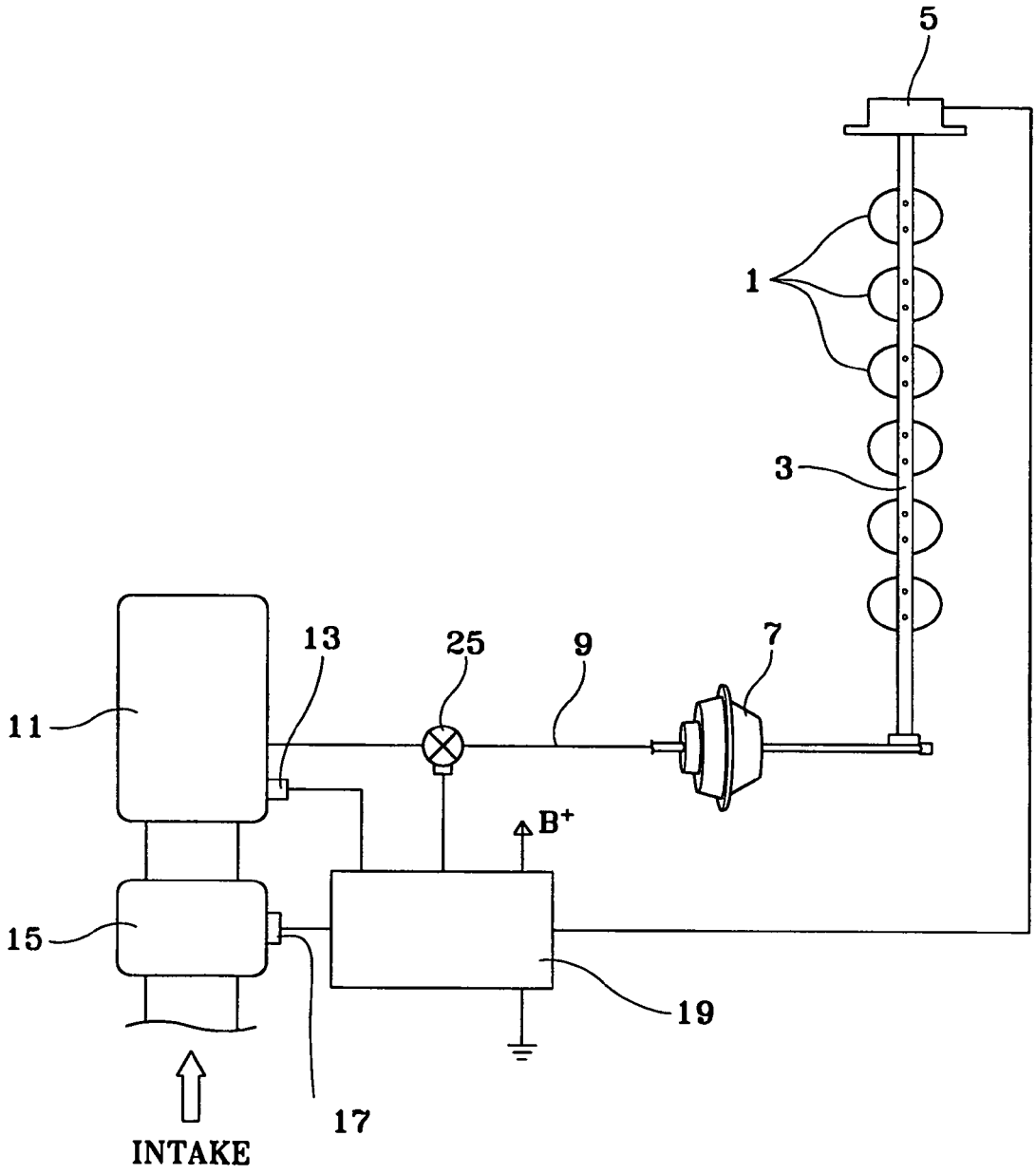
FIG. 1 illustrates a variable intake system monitoring apparatus according to an embodiment of the present invention.

Referring now to FIG. 1, a variable intake system monitoring apparatus comprises a variable intake valve shaft 3 suitably installed with or other comprising a plurality of flaps 1. A potentiometer 5 measures the pivot amount of the variable intake valve shaft 3. A pneumatic actuator 7 pivots the variable intake valve shaft 3. A vacuum hose 9 connects a surge tank 11 and pneumatic actuator 7 to provide operational pressure of the pneumatic actuator 7. A Manifold Absolute Pressure (MAP) sensor 13 is installed preferably in close proximity of the surge tank 11 connected with the vacuum hose 9. A Throttle Position Sensor (TPS) 17 is suitably provided and preferably located at or proximate to a throttle body 15. A controller 19 detects the operation state of the variable intake valve shaft 3 by receiving signals from the potentiometer 5, MAP sensor 13, and/or TPS 17, preferably by receiving signals from each of the potentiometer 5, MAP sensor 13 and/or TPS 17.

The plurality of flaps 1 on the variable intake valve shaft 3 can pivot according to the pivot of the variable intake valve shaft 3 and thereby change the length of the intake passage that extends to the combustion chamber.

The potentiometer 5 is preferably a sensor, preferably the same type of sensor as employed for TPS 17, although differing types of sensors also can be employed. The TPS 17 measuring the extent or amount the throttle valve is open is also a potentiometer that is preferably low in cost and in which its output signal can easily be used. Thus, a sensor measuring the extent or amount the throttle valve is open can be substituted for a monitoring apparatus of the variable intake system, thereby enabling monitoring and diagnosis of the operating state of the variable intake system at relatively low costs.

Figure 2:
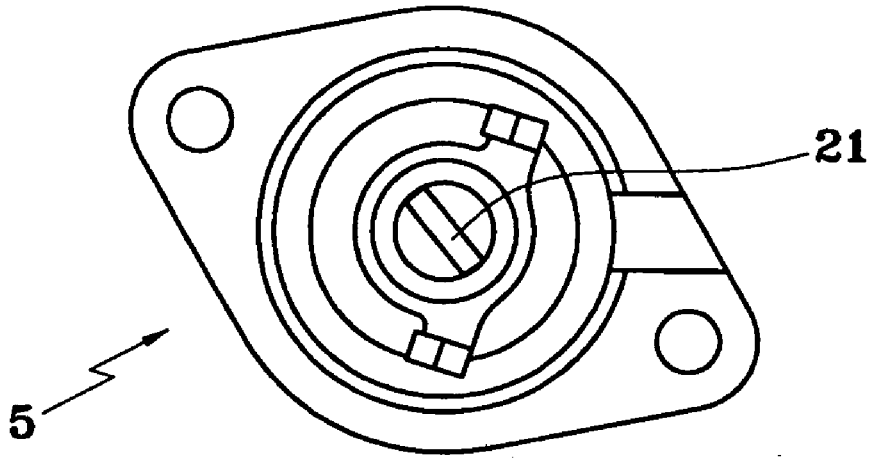
FIG. 2 illustrates a suitable potentiometer.
Figure 3:
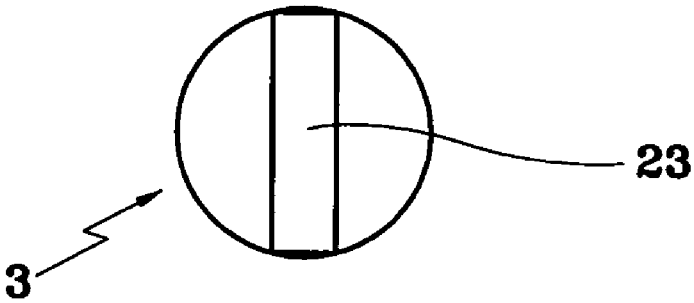
FIG. 3 illustrates a distal end of a variable intake valve shaft to where the potentiometer of FIG. 2 is connected.
Figure 4:
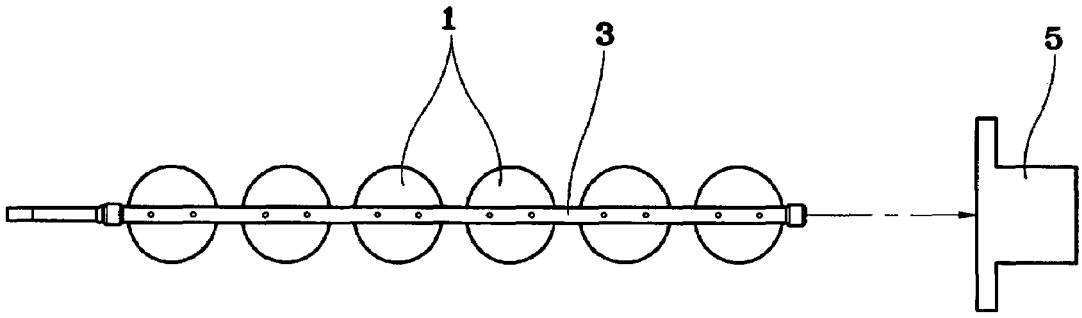
FIG. 4 depicts a coupling state of the potentiometer of FIG. 2 and the variable intake valve shaft of FIG. 3.

With reference to FIG. 2, the potentiometer 5 is formed with a line-shaped protrusion 21 at a distal end of a sensing shaft. A distal end of the variable intake valve shaft 3 is preferably formed with a line-shaped groove 23 into which the line-shaped protrusion 21 is inserted (see FIG. 3). Thus, the potentiometer 5 is assembled onto the variable intake valve shaft 3 as shown in FIG. 4.

The vacuum hose 9 is preferably equipped with a solenoid valve 25. Therefore, if the controller 19 restrains the solenoid valve 25, the amount or extent of vacuum transmitted to the pneumatic actuator 7 varies. This results in a pivot of the variable intake valve shaft 3.

The controller 19 is preferably an Engine Control Unit (ECU) that detects the engine operation state.

The operation of a suitable system of one aspect of the present invention will now be described in detail with reference to the accompanying drawings.

In a situation where the variable intake valve shaft 3 does not pivot due to a disconnection of the vacuum hose 9 and the pneumatic actuator 7 even though the controller 19 sends a pivot signal to the solenoid valve 25, then the controller 19 can detect this malfunction through signals from the TPS 17, potentiometer 5, and MAP sensor 13.

The controller 19 determines that the vacuum hose 9 is separated from the pneumatic actuator 7 if the TPS 17 sends a throttle valve-closed signal, the potentiometer 5 sends flaps 1—closed signal, and the MAP sensor 13 sends a value signal that is close to that of the atmospheric pressure.

When the engine is operating and the throttle valve is closed, the surge tank 11 is filled with high vacuum compared to the atmospheric pressure. However, if the vacuum hose 9 is disconnected, the MAP sensor 13 near the vacuum hose 9 generates a signal close to the atmospheric pressure and the potentiometer 5 emits a signal that the flaps 1 are closed.

The potentiometer 5 outputs a voltage based on the difference of electrical resistance value generated in response to the pivot amount of the flap 1 and variable intake valve shaft 3. The controller 19 monitors and compares the outputted voltage with a data pre-mapped pertaining to the relationship of the output voltage of the potentiometer 5 and rotational angle of the flaps 1, resulting in an accurate monitoring operation.

As indicated by the foregoing, variable intake systems of the invention can monitor valves of the system through simple apparatus, thus providing stable operation of the variable intake system at relatively low costs.

While the invention has been described with reference to specific embodiments, modifications and variations of the invention may be constructed without departing from the scope of the invention, which is defined in the following claims.

What is claimed is:

1. A variable intake system monitoring apparatus, comprising:

a variable intake valve shaft comprising a plurality of flaps;

a potentiometer that measures the pivot amount of the variable intake valve shaft;

a pneumatic actuator that pivots the variable intake valve shaft;

a vacuum line connecting a surge tank and the pneumatic actuator to provide operational pressure of the pneumatic actuator;

a Manifold Absolute Pressure (MAP) sensor positioned proximate to the surge tank connected with the vacuum hose;

a Throttle Position Sensor (TPS) located at a throttle body; and a controller that detects the operation state of the variable intake valve shaft by receiving signals from the potentiometer, MAP sensor, and TPS, wherein the controller monitors and compares the outputted voltage of the potentiometer with data pre-mapped pertaining to the relationship of the output voltage of the potentiometer and rotational angle of the flaps, and detects a disconnection of the vacuum hose from the pneumatic actuator and/or a surge tank via the output voltage of the potentiometer and a signal of the MAP sensor.

2. The apparatus as defined in claim 1, wherein the potentiometer is a sensor of the same type as the the TPS.

3. The apparatus as defined in claim 2, wherein the potentiometer is formed with a line-shaped protrusion at one end of a sensing shaft, and the variable intake valve shaft is formed at one end of thereof with a line-shaped groove into which the line-shaped protrusion is inserted.

4. A variable intake system monitoring apparatus, comprising:

a variable intake valve shaft comprising a plurality of flaps;

a potentiometer that can measure the pivot amount of the variable intake valve shaft;

a pneumatic actuator that can pivot the variable intake valve shaft;

a Manifold Absolute Pressure sensor;

a Throttle Position Sensor located at a throttle body; and a controller that detects the operation state of the variable intake valve shaft by input from one or more of the potentiometer, Manifold Absolute Pressure sensor, or Throttle Position Sensor, wherein the controller monitors and compares the outputted voltage of the potentiometer with data pre-mapped pertaining to the relationship of the output voltage of the potentiometer and rotational angle of the flaps and detects a disconnection of the vacuum hose from the pneumatic actuator and/or a surge tank via the output voltage of the potentiometer and a signal of the MAP sensor.

5. A motor vehicle that comprises the variable intake system monitoring apparatus of claim 1.

6. A motor vehicle that comprises the variable intake system monitoring apparatus of claim 4.

* * * * *